US011136698B2

(12) United States Patent
Lee

(10) Patent No.: US 11,136,698 B2
(45) Date of Patent: Oct. 5, 2021

(54) WEFT KNITTING MACHINE KNITTING STRUCTURE WITH CHANGEABLE YARN POSITIONS

(71) Applicant: PAI LUNG MACHINERY MILL CO., LTD., New Taipei (TW)

(72) Inventor: Hsin-Chung Lee, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 4 days.

(21) Appl. No.: 16/517,042

(22) Filed: Jul. 19, 2019

(65) Prior Publication Data

US 2021/0017680 A1 Jan. 21, 2021

(51) Int. Cl.
*D04B 9/34* (2006.01)
*D04B 15/06* (2006.01)

(52) U.S. Cl.
CPC ..... *D04B 9/34* (2013.01); *D04B 15/06* (2013.01)

(58) Field of Classification Search
CPC ..... D04B 9/34
USPC ..... 66/104
See application file for complete search history.

(56) References Cited

U.S. PATENT DOCUMENTS 1,605,895 A * 11/1926 Lawson ..... D04B 9/28 66/40
1,666,794 A 4/1928 Scott et al.
1,690,268 A * 11/1928 Barth ..... D04B 9/28 66/108 R
1,758,899 A * 5/1930 Lawson ..... D04B 9/26 66/108 R
1,796,266 A * 3/1931 Lawson ..... D04B 9/28 66/108 R
1,811,849 A * 6/1931 Houseman ..... D04B 1/126 66/36
1,950,405 A 3/1934 Holmes et al.
1,977,590 A 10/1934 Page et al.
2,050,962 A * 8/1936 Page ..... D04B 9/26 66/107
2,058,392 A * 10/1936 Seaman ..... D04B 15/80 66/36
2,082,751 A * 6/1937 Lawson ..... D04B 9/28 66/108 R
2,115,929 A * 5/1938 Lawson ..... D04B 15/06 66/107

(Continued)

FOREIGN PATENT DOCUMENTS

CN 2249253 Y 3/1997
CN 104532458 A 4/2015

(Continued)

*Primary Examiner* — Khoa D Huynh
*Assistant Examiner* — Grace Huang
(74) *Attorney, Agent, or Firm* — Muncy, Geissler, Olds & Lowe, P.C.

(57) ABSTRACT

A weft knitting machine knitting structure with changeable yarn positions is provided. A facing yarn and a bottom yarn positioned below the facing yarn are fed during knitting, the weft knitting machine knitting structure comprises a plurality of sinkers and a plurality of needles, the plurality of needles are respectively arranged adjacent to one of the plurality of sinkers, and each of the plurality of sinkers is guided to perform a linear displacement movement. Each of the plurality of needles is provided with a hook and a latch for performing a closing action relative to the hook.

6 Claims, 9 Drawing Sheets

(56) References Cited

U.S. PATENT DOCUMENTS

| | | | | | |
|---|---|---|---|---|---|
| 2,515,505 | A | * | 7/1950 | Getaz | D04B 35/04 66/36 |
| 2,616,276 | A | | 11/1952 | Miller | |
| 2,711,090 | A | * | 6/1955 | Marlette | D04B 1/26 66/215 |
| 3,157,035 | A | | 11/1964 | Boutillette | |
| 5,862,681 | A | * | 1/1999 | Schmidt | D04B 9/12 66/9 R |
| 6,128,930 | A | * | 10/2000 | Schmidt | D04B 35/02 66/92 |
| 6,715,325 | B2 | * | 4/2004 | Sangiacomo | D04B 9/12 66/107 |
| 9,834,871 | B2 | * | 12/2017 | Lee | D04B 1/126 |

FOREIGN PATENT DOCUMENTS

| | | | | | |
|---|---|---|---|---|---|
| GB | 277725 | A | * | 9/1927 | D04B 9/34 |
| GB | 291470 | A | * | 12/1929 | D04B 9/34 |
| GB | 294199 | A | * | 12/1929 | D04B 15/06 |
| GB | 381599 | A | * | 10/1932 | D04B 9/26 |
| GB | 388661 | A | * | 3/1933 | D04B 9/26 |
| GB | 460004 | A | * | 1/1937 | D04B 15/06 |
| WO | WO 0015890 | A | | 3/2000 | |
| WO | WO-2018186499 | A1 | * | 10/2018 | D04B 15/06 |

* cited by examiner

WEFT KNITTING MACHINE KNITTING STRUCTURE WITH CHANGEABLE YARN POSITIONS

FIELD OF THE INVENTION

The invention relates to a weft knitting machine knitting structure, in particular to a weft knitting machine knitting structure with changeable yarn positions.

BACKGROUND OF THE INVENTION

Plating, also known as yarn overlapping, refers to the simultaneous feeding of two differently colored yarns during knitting, causing a technical face and a technical back of a knitted fabric to appear differently colored. However, in order to increase the color or pattern change of the fabric, it has been proposed in the prior art to change the position of the two yarns fed during the knitting process so as to change the color of the plated on the technical face, and the fabric surface thereof is shown in FIG. 1. As such, the foregoing knitting techniques are known in the art as Jacquard.

In U.S. Pat. Nos. 1,666,794, 1,950,405, 3,157,035, 2,616,276, CN 104532458 A, WO 00/15890 A, etc., the positions of two yarns fed are changed by the structure of a yarn carrier itself or a collocation structure. However, since the yarn carrier is still at a distance from the position where the weft knitting machine performs knitting, even though the yarn carrier can immediately change the position of the yarn, a plurality of remotely located needles can still grab the yarns at the unchanged position, resulting in the problem of residual shadow on the fabric, as indicated at a after image 90 in FIG. 2.

In addition, there are also embodiments for accomplishing the need for yarn change through a variety of sinkers, such as disclosed in U.S. Pat. No. 1,977,590 and CN Patent No. 2,249,253Y, but such an embodiment would result in a significant reduction in the number of needles that can be deployed per opening of the weft knitting machine and would not be suitable for the current industry's need for needle number.

SUMMARY OF THE INVENTION

The main purpose of the present invention is directed to solve the problem in the prior art that a yarn carrier used for knitting yarns would cause after images appeared on a fabric easily.

The secondary object of the present invention is directed to solve the practical problems deriving from the fact that yarn changes are required to be carried out in a variety of sinkers in conventional techniques.

In order to achieve the above object, the present invention provides a weft knitting machine knitting structure with changeable yarn positions, wherein a facing yarn and a bottom yarn positioned below the facing yarn are fed during knitting. The weft knitting machine knitting structure comprises a plurality of sinkers and a plurality of needles. The plurality of sinkers is respectively arranged adjacent to one of the plurality of needles. Each of the plurality of sinkers comprises a belly, a nose connected with the belly, and a throat between the belly and the nose. Each of the plurality of sinkers is guided to perform a linear displacement movement, wherein the facing yarn is positioned above the nose and the bottom yarn is positioned in the throat in a process of the linear displacement movement. The plurality of needles respectively includes a hook and a latch for performing a closing action relative to the hook. Each of the needles is controlled to move in a first needle retracting track knitting a standard plating without changing positions of the facing yarn and the bottom yarn in the hook, or to move in a second needle retracting track knitting an interchanged plating with changing the positions of the facing yarn and the bottom yarn in the hook. In the second needle retracting track, the latch dials the bottom yarn to make the bottom yarn pushed by the nose of one of the plurality of sinkers when one of the plurality of sinkers adjacent to each of the plurality of needles does not restrict positions of the facing yarn and the bottom yarn. The time point for the latch of each of the plurality of needles generating the closing action in the second needle retracting track is earlier than the first needle retracting track.

In one embodiment, the weft knitting machine knitting structure comprises a needle guide plate guiding the plurality of needles in a first needle retracting track or the second needle retracting track, and a sinker guide plate guiding the plurality of sinkers to perform the linear displacement movement. Further, the weft knitting machine knitting structure comprises a needle selector for controlling each of the needles.

In one embodiment, each of the plurality of sinkers has only a single motion track, and the motion track cycles through a first retraction section, a first push-out section subsequent to the first retraction section, a second retraction section subsequent to the first push-out section, and a second push-out section subsequent to the second retraction section. The time point for the latch of each of the plurality of needles generating the closing action in the first needle retracting track is that one of the plurality of sinkers adjacent to the latch moves to the second retraction section, and the time point for the latch of each of the plurality of needles generating the closing action in the second needle retracting track is that one of the plurality of sinkers adjacent to the latch moves to the first push-out section.

In one embodiment, the top yarn and the bottom yarn are different in color.

Through the implementation of the invention and compared with the conventional application, the invention has the following characteristics: according to the weft knitting machine knitting structure disclosed by the invention, the change of the yarn position is carried out at the feeding points of the facing yarn and the bottom yarn, so that the knitting requirement for changing yarns can be quickly performed, and the after image on the fabric is specifically avoided. Besides, the weft knitting machine knitting structure provided by the invention can achieve the purpose of quick yarn changing and knitting without greatly modifying the integral structure.

DETAILED DESCRIPTION OF THE PREFERRED EMBODIMENTS

Figure 1:
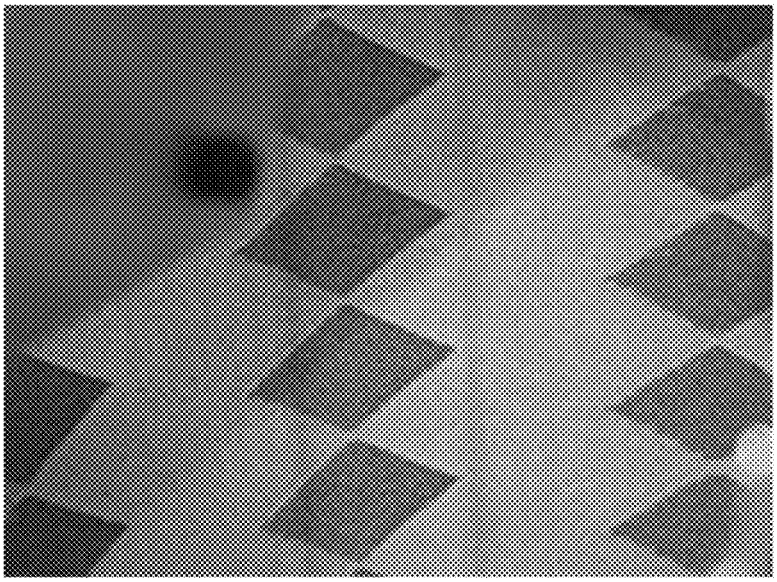
Fig. 1 PRIOR ART
FIG. 1 is a schematic diagram of fabric surface when the yarn is changed correctly in the fabric.
Figure 2:
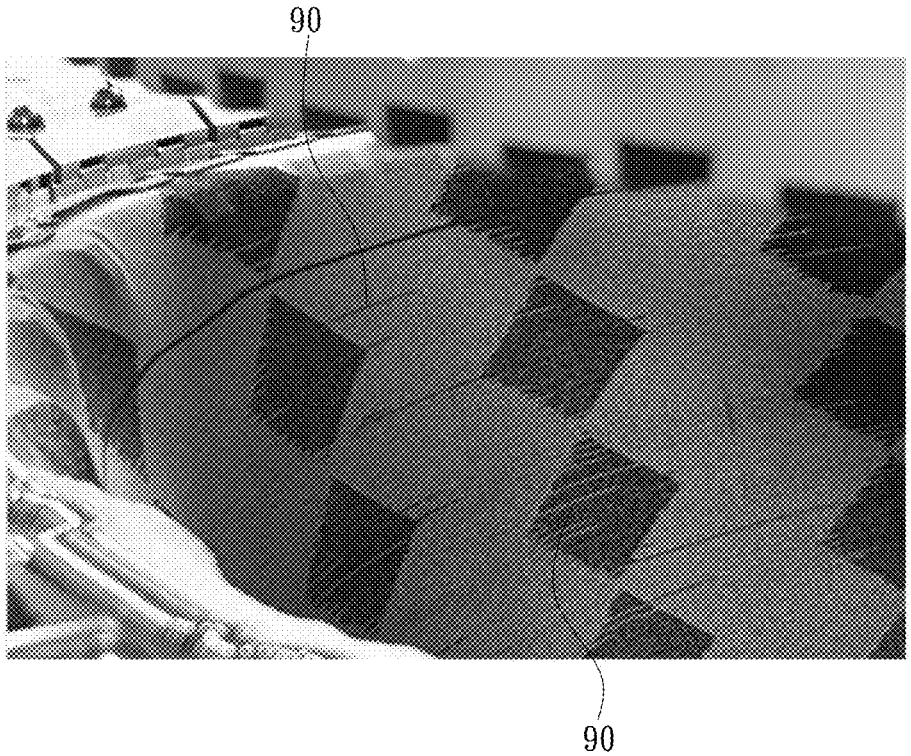
Fig. 2 PRIOR ART
FIG. 2 is a schematic diagram of the fabric with a residual shadow.
Figure 3:
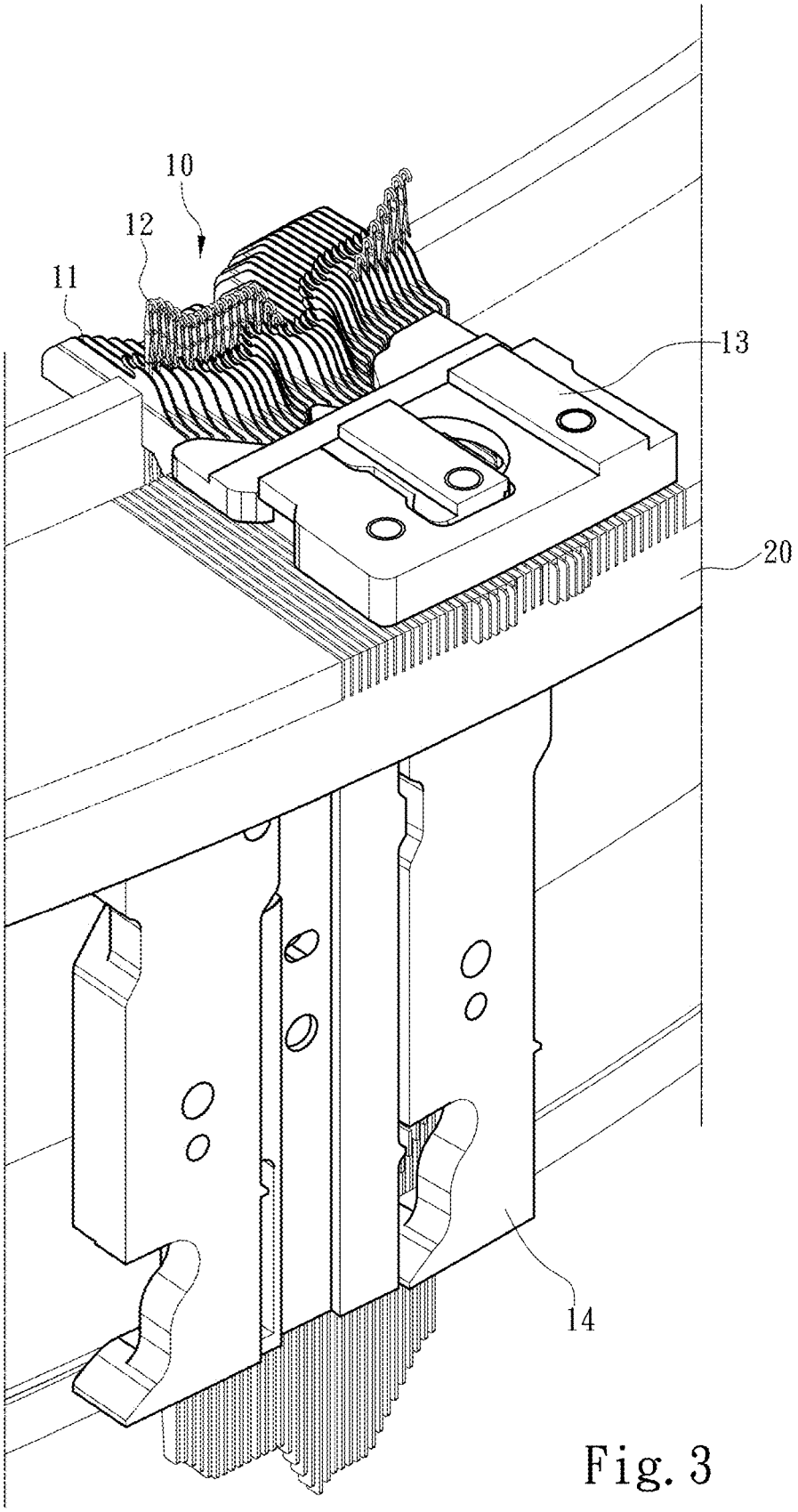
FIG. 3 is a structurally schematic view showing a weft knitting machine knitting structure according to one embodiment of the present invention.
Figure 4:
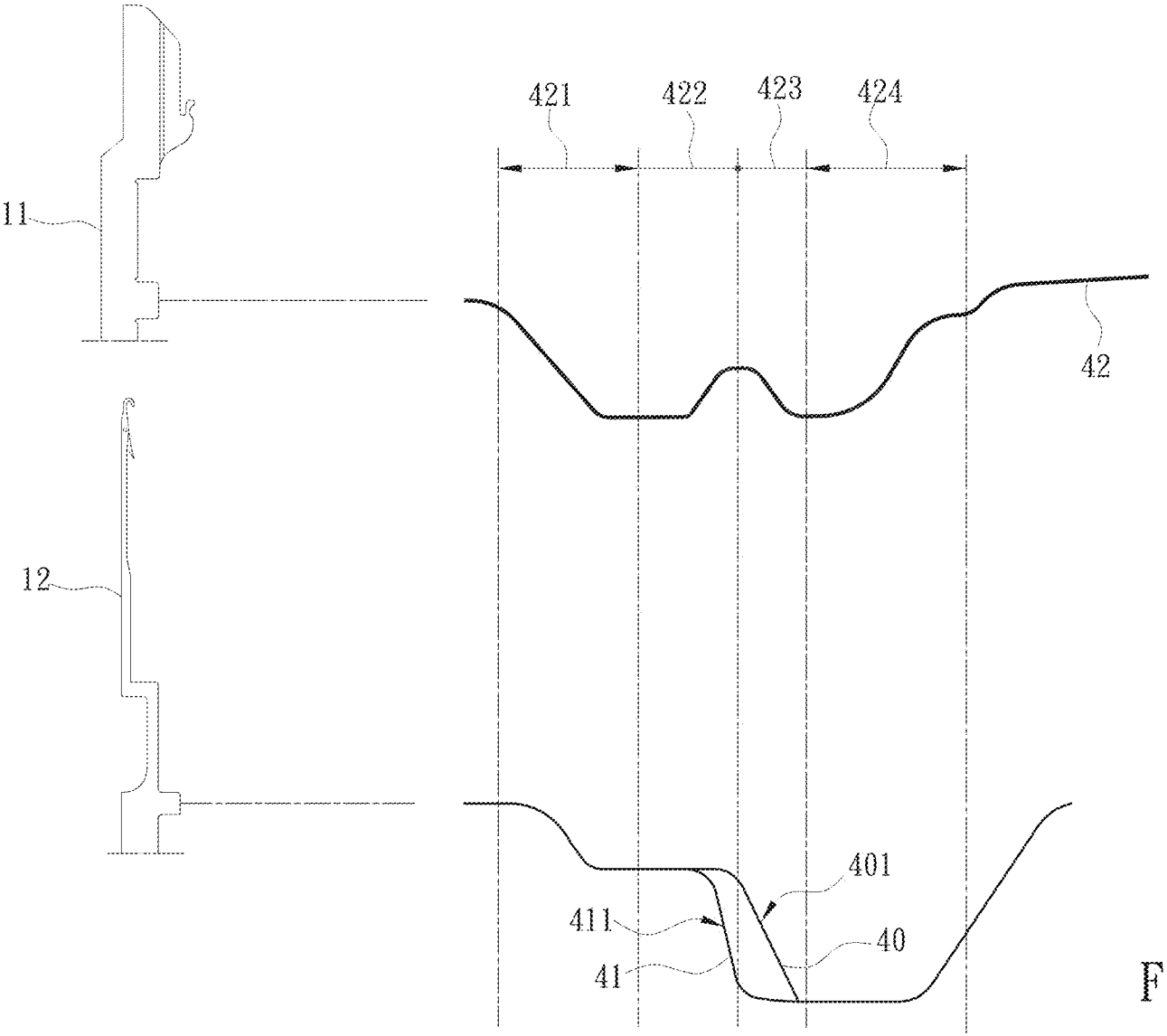
FIG. 4 is a comparison diagram of tracks of a needle and a sinker according to one embodiment of the invention.
Figure 5:
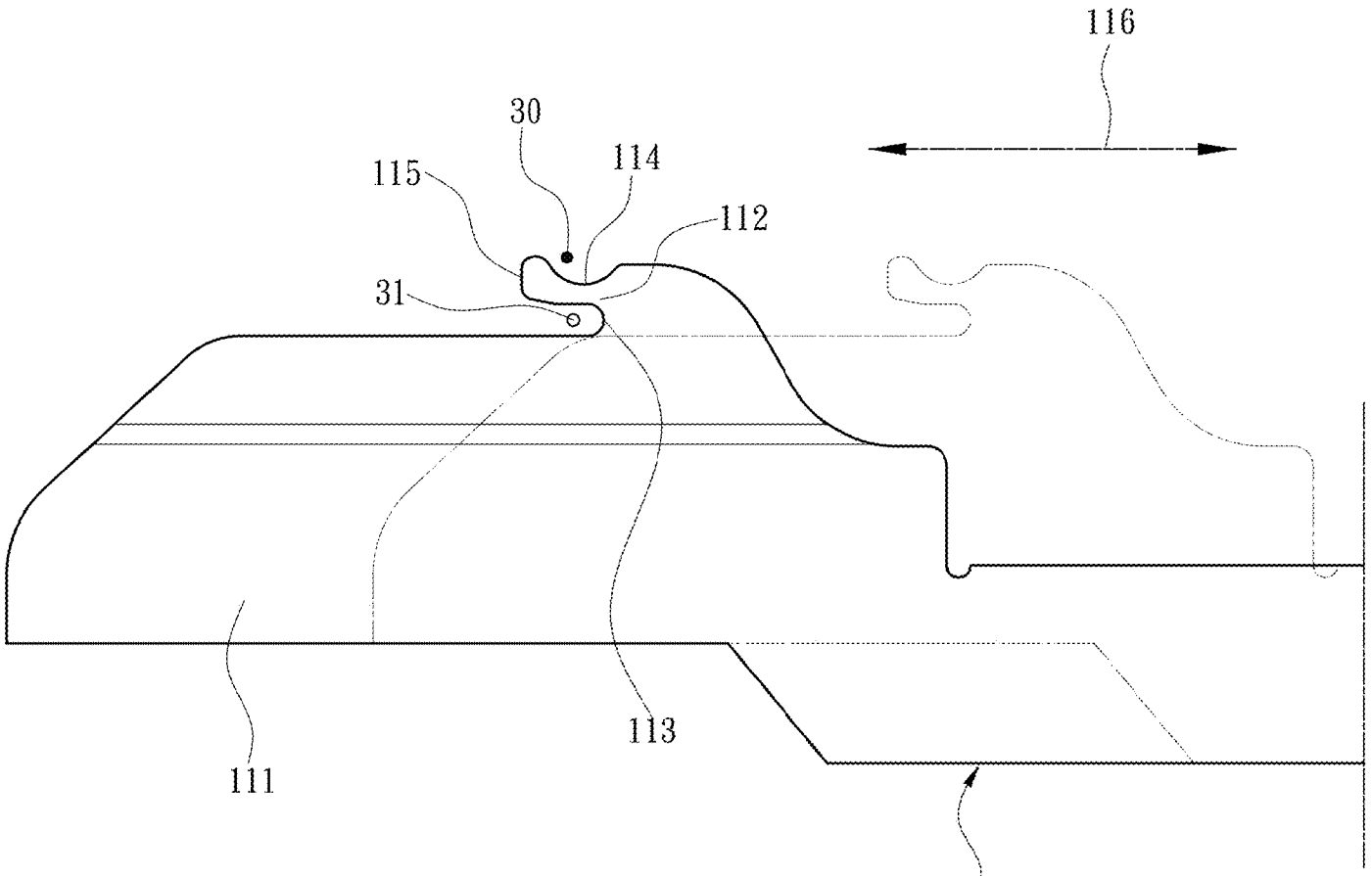
FIG. 5 is a schematic diagram of the action of a sinker according to one embodiment of the present invention.

The detailed description and technical contents of the present invention will now be described with reference to the drawings as follows:

Referring to FIGS. 3, 4 and 5, the present invention provides a weft knitting machine knitting structure 10 with changeable yarn positions, which is provided on a needle bed 20 of a weft knitting machine, and the weft knitting machine is a circular knitting machine. The weft knitting machine knitting structure 10 comprises a plurality of sinkers 11 and a plurality of needles 12, wherein the plurality of sinkers 11 are arranged at equal intervals, and each of the plurality of sinkers 11 comprises a belly 111, a nose 112 connected with the belly 111, and a throat 113 between the belly 111 and the nose 112. A yarn-bearing surface 114 of each of the plurality of sinkers 11 is located on a side of the nose 112 without facing the throat 113, and the yarn-bearing surface 114 is not limited by a plane and is able to be designed according to implementation requirements. On the other hand, yarn-pushing surface 115 is located at an end of the nose 112, the yarn-pushing surface 115 is flat in this embodiment, but is not so limited and is able to be designed according to the implementation requirements. Further, each of the plurality of sinkers 11 of the present invention is guided by a sinker guide plate 13 to perform a linear displacement movement 116. Further, the linear displacement movement 116 is actually a one-dimensional movement.

Figure 6:
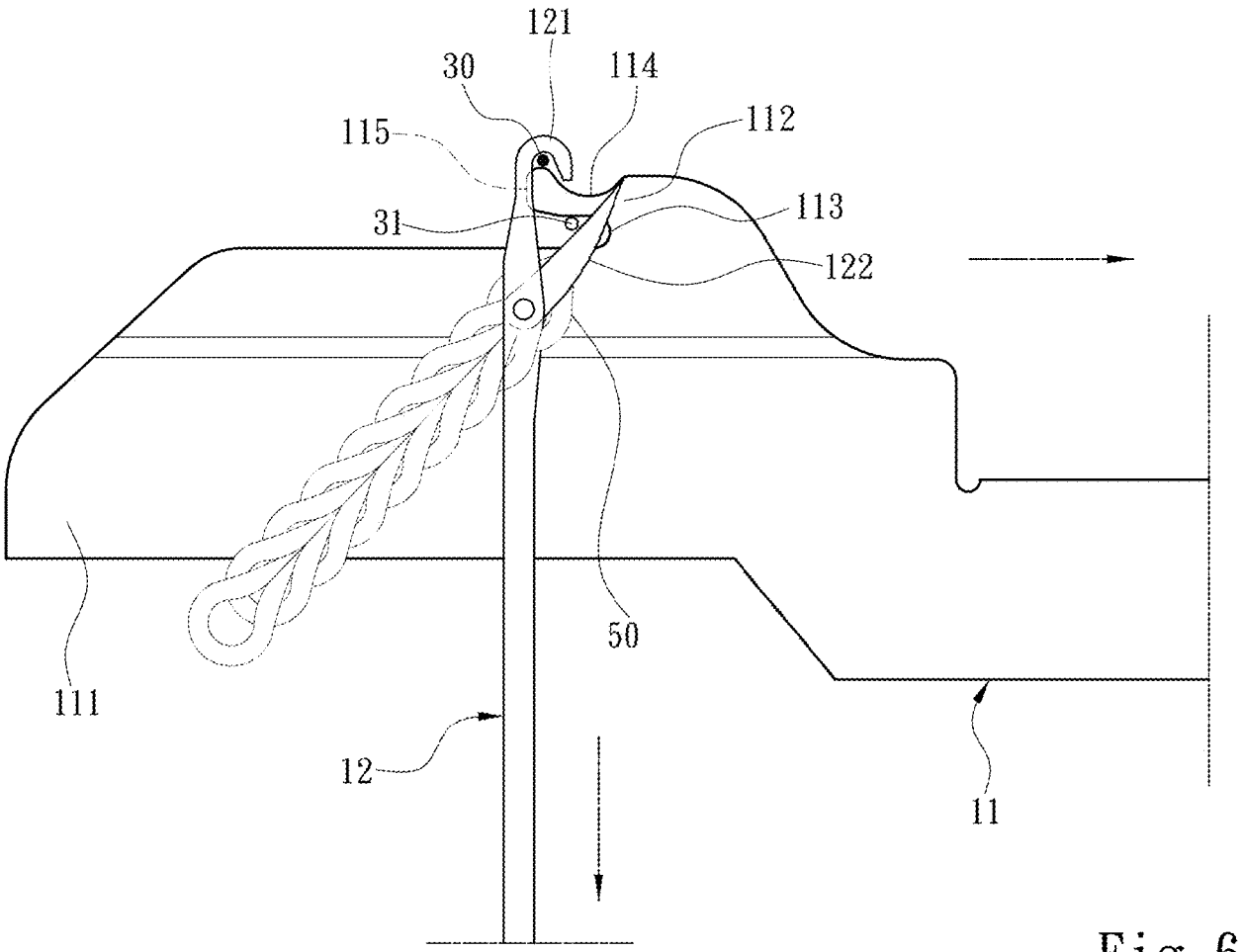
FIG. 6 is a needle retracting action schematic diagram when a needle moves in a first needle retracting track according to an embodiment of the invention.

Referring to FIGS. 3, 4, 5 and 6, the plurality of needles 12 are disposed adjacent to one of the plurality of sinkers 11 respectively, that is, each of the plurality of needles 12 is disposed between any two of the plurality of sinkers 11 that are adjacent. Each of the plurality of needles 12 comprises a hook 121 and a latch 122 performing a closing action relative to the hook 121. Further, when each of the plurality of needles 12 moves to hook a yarn, the latch 122 performs opening relative to the hook 121 so that the yarn is able to enter the hook 121. Furthermore, when each of the plurality of needles 12 is retracted, the latch 122 performs the closing action in the direction towards the hook 121 due to the action of a previous knitted plating 50, closing the originally open portion of the hook 121. Further, the plurality of needles 12 of the present invention are arranged in a direction that the open portion of the hook 121 faces the throat 113 adjacent to one of the plurality of sinkers 11, as shown in FIG. 6. Further, the motion direction of the plurality of needles 12 of the present invention is perpendicular to the direction of the linear displacement movement 116, and the plurality of needles 12 are controlled by a needle guide plate 14 respectively for guiding each of the plurality of needles 12 to move in a first needle retracting track 40 or a second needle retracting track 41. Further, each of the plurality of needles 12 is controlled by a needle selector (not shown in the drawings). Furthermore, a time point 411 for the latch 122 of each of the plurality of the needles 12 performing the closing action in the second needle retracting track 41 is earlier than in the first needle retracting track 40.

Referring to FIGS. 3, 4 and 5, the weft knitting machine knitting structure 10 receives a facing yarn 30 and a bottom yarn 31 positioned below the facing yarn 30 that are fed by a yarn-feeding device (not shown in the drawings) during knitting. In one embodiment, the color of the facing yarn 30 is different color from the color of the bottom yarn 31. Specifically, herein presenting inaction of the plurality of needles 12 explains the relationship among each of the plurality of sinkers 11, the facing yarn 30 and the bottom yarn 31 for the moment. Thus, each of the plurality of sinkers 11 is guided by the sinker guide plate 13 to carry out the linear displacement movement 116, and in the process of the linear displacement movement 116, the facing yarn 30 is always positioned above the nose 112, and the bottom yarn 31 is always positioned in the throat 113. Further, each of the plurality of sinkers 11 only performs one-dimensional movement.

Figure 7:
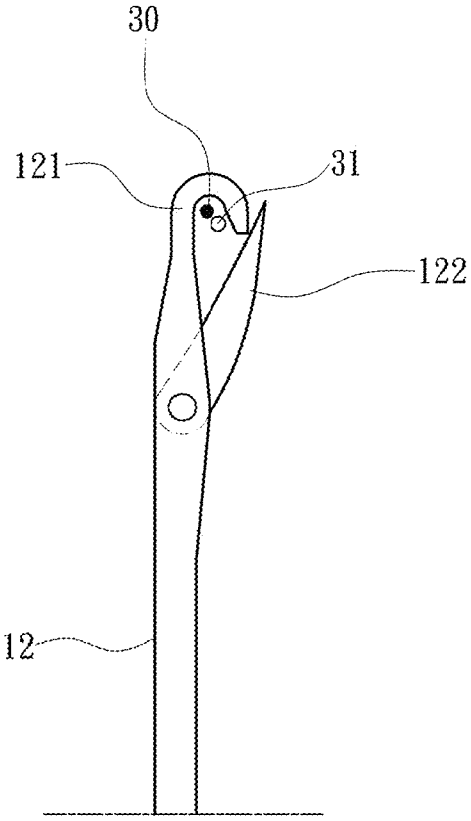
FIG. 7 is a schematic diagram showing the position of the top yarn and the bottom yarn during standard plating according to one embodiment of the invention.
Figure 8:
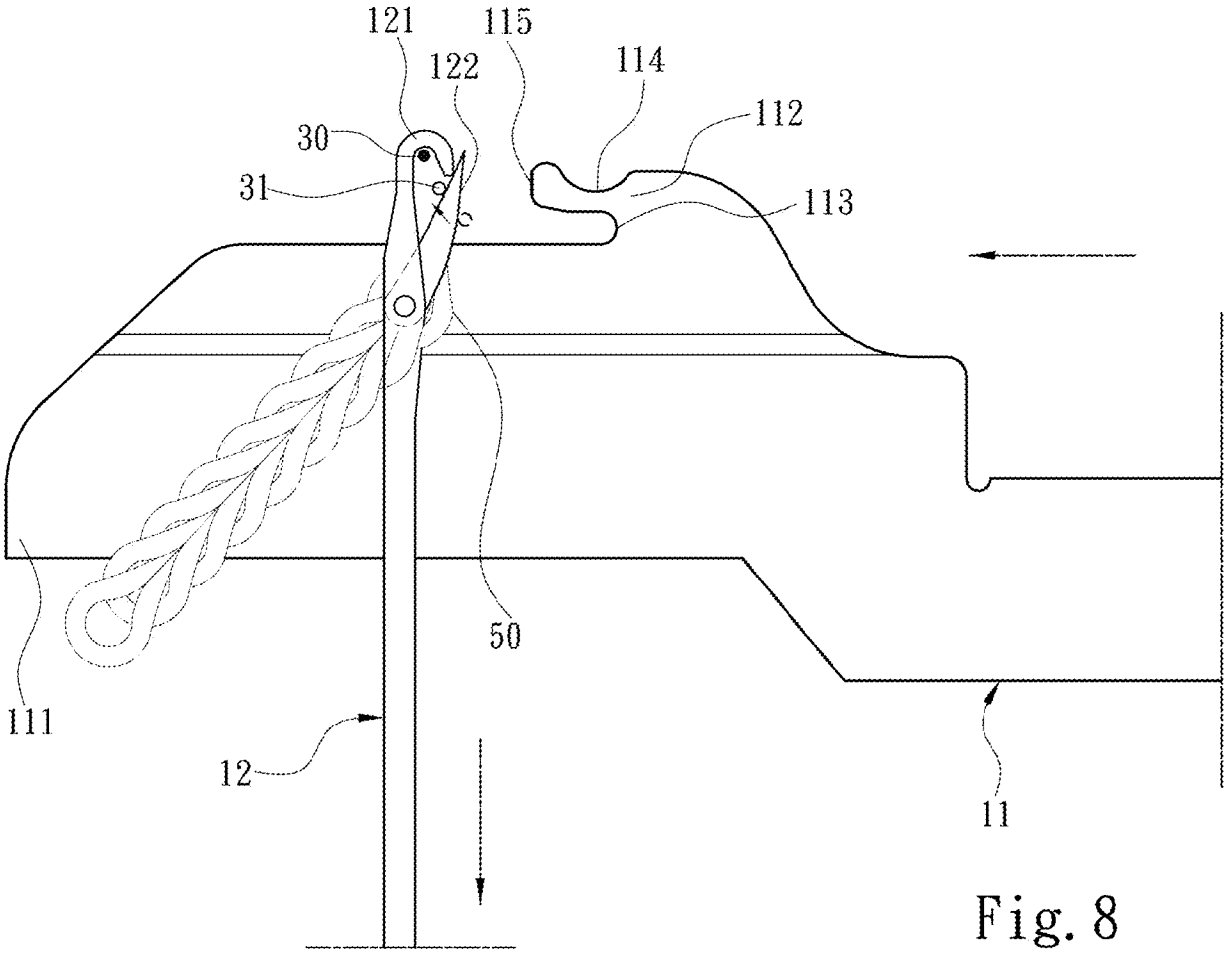
FIG. 8 is a needle retracting action schematic diagram (1) when a needle moves in a second needle retracting track according to one embodiment of the invention.
Figure 9:
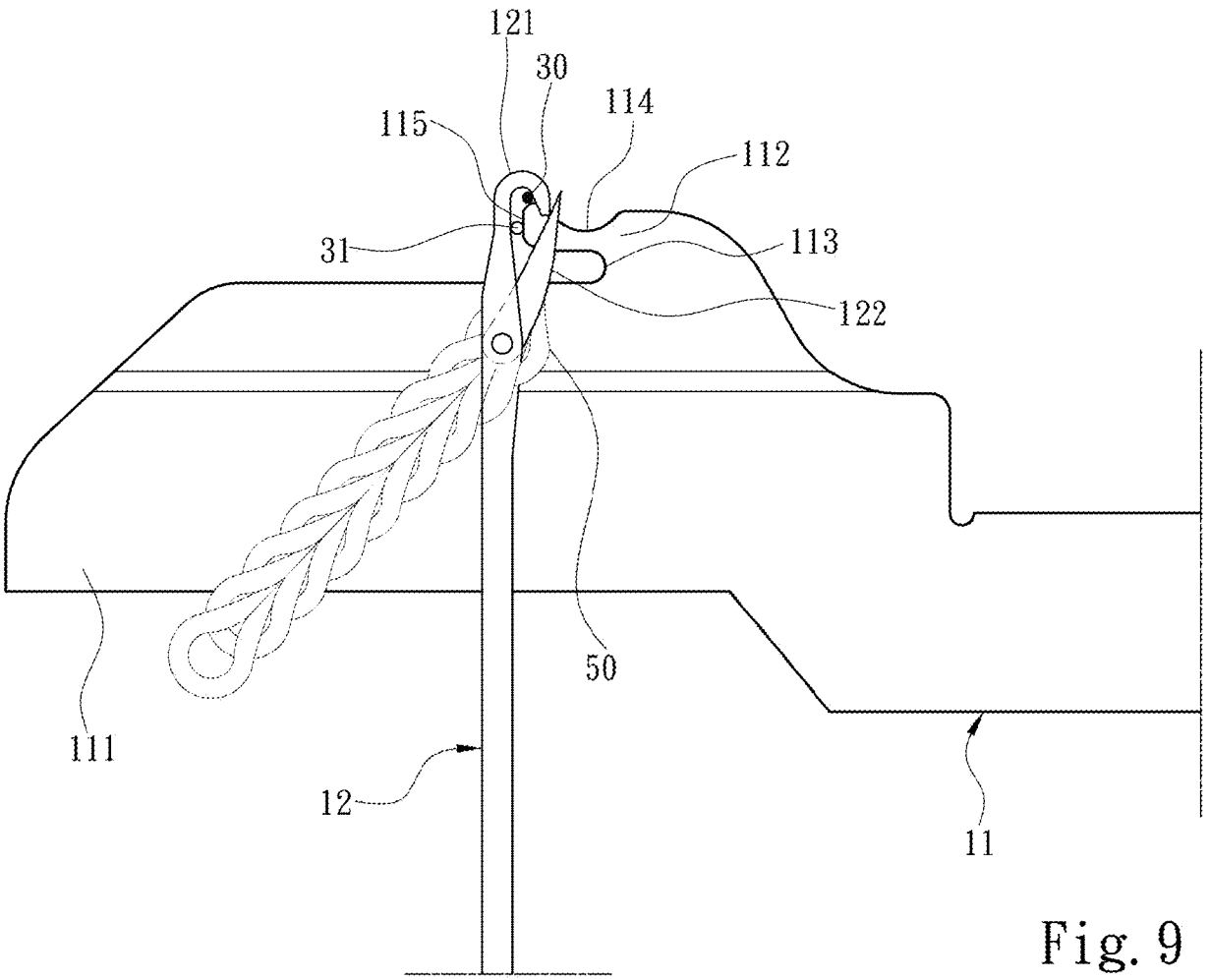
FIG. 9 is a needle retracting action schematic diagram (2) when a needle moves in a second needle retracting track according to one embodiment of the invention.
Figure 10:
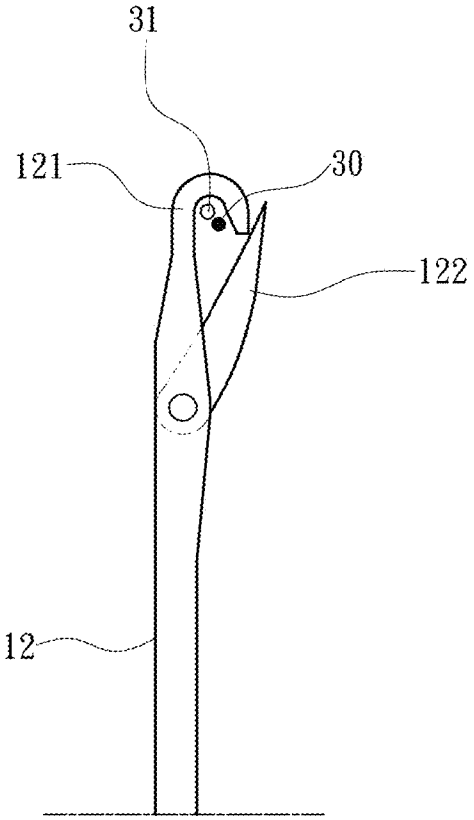
FIG. 10 is a schematic diagram showing the positions of a top yarn and a bottom yarn in a hook during interchanged plating according to one embodiment of the invention.

With reference to FIGS. 4, 6 and 7, the operation of each of the plurality of needles 12 is explained by illustrating the overall operation of the weft knitting machine knitting structure 10. Accordingly, when each of the plurality of needles 12 moves in the first needle retracting track 40, each of the plurality of needles 12 knits a standard plating without changing positions of the facing yarn 30 and the bottom yarn 31 in the hook 121, and the so-called "the standard plating" refers to a plating in which the facing yarn 30 is positioned above the bottom yarn 31 when viewing from a technical face of a fabric. Then referring to FIGS. 8, 9 and 10, when each of the plurality of needles 12 of the present invention moves in the second needle retracting track 41 such that one of the plurality of sinkers 11 adjacent to each of the plurality of needles 12 does not restrict positions of the facing yarn 30 and the bottom yarn 31, the latch 122 dials the bottom yarn 31 to make the bottom yarn 31 be pushed by the nose 112 of the plurality of sinkers 11, so as to change the positions of the facing yarn 30 and the bottom yarn 31 in the hook 121, then to knit an interchanged plating. The so-called "the interchanged plating" refers to a plating in which the facing yarn 30 is positioned under the bottom yarn 31 when viewing from the technical face of the fabric. Thus, the motion of the plurality of needles 12 in the first needle retracting track 40 or the second needle retracting track 41 determines whether the weft knitting machine knitting structure 10 of the present invention changes the position of the yarn.

Referring to FIGS. 4, 6 and 7, each of the plurality of sinkers 11 of the present invention only comprises one motion track 42 that recurring operations of a first retraction section 421, a first push-out section 422 subsequent to the first retraction section 421, a second retraction section 423 subsequent to the first push-out section 422, and a second push-out section 424 subsequent to the second retraction section 423. Here, the retraction of the present invention is defined that each of the plurality of sinkers 11 moves in a direction opposing to the feeding point of the facing yarn 30 and the bottom yarn 31, so that the facing yarn 30 and the bottom yarn 31 are not restricted by the plurality of sinkers 11. Further, the push-out action of the present invention is defined that after the retraction each of the plurality of sinkers 11 moves toward the feeding point of the facing yarn 30 and the bottom yarn 31, so that the facing yarn 30 and the bottom yarn 31 are restricted by the plurality of sinkers 11 and unable to change position. Thus, each of the plurality of sinkers 11 in each section of the motion track 42 varies the position continuously, rather than being located at a single location. Referring to FIGS. 4, 6 and 7, when each of the plurality of needles 12 moves in the first needle retracting track 40, the time point 401 for the latch 122 generating the closing action is that one of the plurality of sinkers 11 adjacent to the latch 122 moves to the second retraction section 423. Thus, the facing yarn 30 and the bottom yarn 31 are hooked by the hook 121 in a state of being initially fed into the weft knitting machine knitting structure 10. Referring to FIGS. 4, 8, 9 and 10, on the other hand, when each of the plurality of needles 12 moves in the second needle retracting track 41, the time point 411 for the latch 122 generating the closing action is that one of the plurality of sinkers 11 adjacent to the latch 122 moves to the first push-out section 422. In detail, the time point 401/411 for the latch 122 generating the closing action is not at the end point of the first push-out section 422, and is a stage that each of the plurality of sinkers 11 still does not restrict the position of the facing yarn 30 and the bottom yarn 31 in the first push-out section 422 instead. Therefore, when the latch 122 of each of the plurality of needles 12 performs the closing action, the bottom yarn 31 is dialed so that the bottom yarn 31 is diverged from the original position and is positioned on the displacement track of the nose 112 adjacent to one of the plurality of sinkers 11, and the plurality of sinkers 11 continuously performing a pushing action is allowing the yarn-pushing surface 115 to push the bottom yarn 31, so as to change the position of the bottom yarn 31 relative to the facing yarn 30 until the hook 121 of one of the plurality of needles 12 is hooked.

Accordingly, the present invention performs position change at the position where the facing yarn 30 and the bottom yarn 31 are fed into the weft knitting machine knitting structure 10 to perform jacquard knitting. Compared with the conventional, the yarn changing reaction time of the weft knitting machine knitting structure 10 is real-time, and the problem that patterns of a fabric appears after image due to slow yarn changing reaction speed of the conventional can be solved.

What is claimed is:

1. A weft knitting machine knitting structure with changeable yarn positions, wherein a facing yarn and a bottom yarn positioned below the facing yarn are fed during knitting, the weft knitting machine knitting structure comprising:

a plurality of sinkers respectively comprising a belly, a nose connected with the belly, and a throat between the belly and the nose, wherein each of the plurality of sinkers is guided to perform a linear displacement movement, wherein the facing yarn is positioned above the nose and the bottom yarn is positioned in the throat in a process of the linear displacement movement; and a plurality of needles respectively arranged adjacent to one of the plurality of sinkers, a motion of the plurality of needles being perpendicular to a direction of the linear displacement movement, each of the plurality of needles including a hook and a latch for performing a closing action relative to the hook, wherein in a first needle retracting track, each of the plurality of needles generating a closing action of the latch at a latch closing time point; and in a second needle retracting track, each of the plurality of needles controls the latch generating the closing action of the latch before the latch closing time point;

wherein each of the plurality of needles in the first needle retracting track knits a standard plating without changing positions of the facing yarn and the bottom yarn in the hook; and wherein each of the plurality of needles in the second needle retracting track knits an interchanged plating with changing the positions of the facing yarn and the bottom yarn in the hook, wherein in the second needle retracting track, the latch dials the bottom yarn to make the bottom yarn pushed by the nose of one of the plurality of sinkers when one of the plurality of sinkers adjacent to each of the plurality of needles does not restrict the positions of the facing yarn and the bottom yarn.

2. The weft knitting machine knitting structure with changeable yarn positions according to claim 1, wherein the weft knitting machine knitting structure comprises a needle guide plate guiding the plurality of needles in the first needle retracting track or the second needle retracting track, and a sinker guide plate guiding the plurality of sinkers to perform the linear displacement movement.

3. The weft knitting machine knitting structure with changeable yarn positions according to claim 2, wherein the weft knitting machine knitting structure comprises a needle selector controlling each of the plurality of needles.

4. The weft knitting machine knitting structure with changeable yarn positions according to claim 3, wherein each of the plurality of sinkers only comprises one motion track that recurs operations of a first retraction section, a first push-out section subsequent to the first retraction section, a second retraction section subsequent to the first push-out section, and a second push-out section subsequent to the second retraction section, and wherein the time point for the latch of each of the plurality of needles generating the closing action in the first needle retracting track is that one of the plurality of sinkers adjacent to the latch moves to the second retraction section, and the time point for the latch of each of the plurality of needles generating the closing action in the second needle retracting track is that one of the plurality of sinkers adjacent to the latch moves to the first push-out section.

5. The weft knitting machine knitting structure with changeable yarn positions according to claim 4, wherein the facing yarn and the bottom yarn are different in color.

6. The weft knitting machine knitting structure with changeable yarn positions according to claim 1, wherein the facing yarn and the bottom yarn are different in color.

* * * * *